United States Patent [19]

Eiermann

[11] 4,056,338

[45] Nov. 1, 1977

[54] ROTARY PISTON ENGINE

[75] Inventor: Dankwart Eiermann, Lindau, Germany

[73] Assignee: Wankel GmbH, Lindau, Germany

[21] Appl. No.: 715,662

[22] Filed: Aug. 19, 1976

Related U.S. Application Data

[63] Continuation of Ser. No. 374,045, June 27, 1973, abandoned.

[30] Foreign Application Priority Data

July 5, 1972 Germany ..... 2232997

[51] Int. Cl.[2] ..... F04C 27/00

[52] U.S. Cl. ..... 418/119; 418/121

[58] Field of Search ..... 418/119, 120, 121, 122, 418/123

[56] References Cited

U.S. PATENT DOCUMENTS

| | | | |
|---|---|---|---|
| 3,193,188 | 7/1965 | Bentele | 418/121 |
| 3,269,369 | 8/1966 | Ehrhardt | 418/123 |
| 3,674,384 | 7/1972 | Larrinaga et al. | 418/120 |

*Primary Examiner*—Carlton R. Croyle
*Assistant Examiner*—Leonard Smith
*Attorney, Agent, or Firm*—Walter Becker

[57] ABSTRACT

A rotary piston engine in which the housing has an opening in at least one end wall that is controlled by the piston. The end seals on the piston and the sealing bolts at the juncture thereof are located radially inwardly from the opening, while the corner seals of the piston have legs at the ends of the piston extending to the sealing bolts. The corner seals are disposed in planes which in the radially inward direction diverge from the radial planes of the piston passing through the corners of the piston.

13 Claims, 3 Drawing Figures

ROTARY PISTON ENGINE

This is a continuation of application Ser. No. 374,045, filed June 27, 1973, now abandoned.

The present invention relates to a corner seal and a rotary piston engine in which said seal comprises a corner section, a sealing bolt and sealing strips, and more specifically concerns a corner seal for a rotary piston engine with a housing that includes a mantle having a multi-arc inner surface of an epitrochoidal cross section, said housing also comprising side parts and is confined by an inner chamber through which a crankshaft extends perpendicularly with regard to the side parts while said crankshaft comprises an eccentric having rotatably mounted thereon a multicornered piston, said rotary piston engine having in at least one side part an inlet control opening.

Corner seals of this type are necessary in order on one hand to seal the individual working chambers relative to each other, and on the other hand to seal said individual working chambers relative to the bearing and transmission chambers of the machine.

It is desirable that the cross section of the inlet control opening is as large as possible in order to obtain a quick and complete sealing of the suction chamber or when the engine operating as motor is supercharged or when the engine operates as a multistage compressor to reduce the flow resistance for the working medium to be transferred in compressed condition. The extension of the lateral inlet control opening is determined in the direction of rotation of the piston by the sealing strip over the inlet control opening at the time of the maximum expansion of the intake chamber, and is determined in axial direction by the location of the axial sealing elements. Inasmuch as these sealing elements are by spring pressure pressed against the lateral wall, they would when passing over the inlet opening abut against the edges thereof and drop into said inlet opening if they have smaller dimensions as is the case, for instance, with the sealing bolts. The lateral inlet control opening must be so arranged and dimensioned that it cannot be intersected by the sliding path of such sealing elements or can be intersected only by a smaller portion of the width of said paths. As illustrated, for instance, in FIG. 3 of the German Auslegeschrift No. 1,209,356, it is therefore necessary that between the lateral inlet control opening and the mantle path there remains a wide strip at the rear of the slide wall as sliding path for corner parts of the radial seal and the sealing bolts. To the same end, German Pat. No. 1,102,476 suggested a web for the path of the above mentioned sealing parts which web bridges the inlet control opening and thereby divides the same into two sections. In this way, it is possible to widen the extension of the control opening in the direction toward the mantle path. However, on one hand, this merely displaces the path which limits the inlet cross section without yielding the possibility that the inlet cross section can be materially increased. On the other hand, considerable flow resistance is created by said web.

With heretofore known customary designs of piston corner seals, attention was paid only to prevent the small sealing elements such as sealing bolts or corner parts from sliding over the control opening, whereas with the sealing strips attention was paid only to the fact that the course of the edges does not align with the course of the edges of the control opening in order by a scissors-like sliding over each other to prevent an abutment. With supercharged engines and multistage compressors in which the working medium is under pressure transferred into the suction chamber through the inlet control opening, it will be appreciated with such an arrangement the pressure will when passing over the control opening pass through the axial gas seal behind said gas seal. The pressure oscillations resulting therefrom in the chamber between the axial gas seal and the inner seal act upon the latter in a non-permissible manner and may bring about tumbling movements of the piston.

Various suggestions have been made for the axial gas seal, with which the above mentioned harmful effect would not occur. Between the radial seals and a circular axial gas seal sliding ring, in such an instance, connecting sealing strips arranged in radial direction are provided. As a result thereof, within the region of the piston corner, the axial gas seal may be placed relatively wide toward the inside so that this seal would not slide over a control opening of a greater cross section. Also, the danger of abutting or dropping of sealing bolts or corner pieces of the radial seals can in this way be avoided because the sealing bolts are no longer required, whereas the corner pieces are formed by the connecting strips which thus will be longer than the cross section of the control opening may be (U.S. Pat. No. 3,193,188, FIGS. 1 and 3, German patent No. 1,451,856, in which no corner parts and sealing bolts are needed). These suggestions, however, are of little use in connection with the present invention due to the fact that a permanent type connection between the radial seal and the axial seal sliding ring cannot be established in view of the oscillations of the radial seal. The solution described in German Auslegeschrift No. 1,225,554 which uses the same principle accoring to which, instead of connecting sealing strip has two pairs of wedges by means of which a sealing connection can be established is, however, likewise not suitable for the present invention because these wedge members drop into the control opening or may abut the edges thereof.

German Auslegeschrift No. 1,190,726 discloses a piston seal according to which the radial seal is inclined with regard to the connecting line from the piston corner to the piston center. As a result thereof, on one side of the radial seal on the piston end face there is created a large space which is free from sealing elements and which could be used for enlarging the control opening. However, this possibility has not been recognized by the inventor of the subject matter of said German Auslegeschrift, and the inclined position to the strip is merely to serve for preventing oscillations which produce chatter marks with such so-called drag strip.

It is, therefore, an object of the present invention to provide a corner seal for the piston of a rotary piston engine in which the lateral inlet control opening will have a large cross section with low flow resistance while on the other hand the pressure of the working medium which enters through said control opening will be prevented from passing behind the axial gas seal of the piston. These and other objects and advantages of the invention will appear more clearly from the following specification, in connection with the accompanying drawing, in which.

The corner seal according to the present invention is characterized primarily in that the sealing strips and the sealing bolt extend radially inwardly to such an extent that their sliding path is located inwardly outside the lateral inlet opening and that the corner part comprises a leg which is extended up to the sealing bolt and while engaging the lateral wall acts as a sealing strip. In order to be sure that this leg will be sufficiently placed against the side wall, its engaging surface may be slanted at an angle of approximately 30 degrees for the strip spring. In such an instance no additional springs are needed in the groove of the leg, and the strip spring will suffice for pressing the seaing strip against the leg. In order to enlarge the surface on the piston end face which is available for an enlargement of the lateral inlet control opening according to the invention, it is expedient to arrange the strip groove and therefore the groove for receiving the leg of the corner part at an angle with regard to the center line of the piston which passes through the piston corner.

Inasmuch as the leg of the corner part slides over the inlet control opening, it would be possible that the pressure of the working medium is conveyed through the groove of the leg and a milled radial groove in the sealing bolt into the space between the gas seal and the inner seal. In order to prevent this from happening, it is suggested to close this radial groove by a closure bolt inserted into said radial groove. On the other hand, in order to be able to convey the necessary pressure into said space behind the bolt, it is suggested according to the invention to establish communication between this space through an axial groove in the sealing bolt with the groove space of the leg of said corner part. This strip groove and the groove for the leg of the corner part may be milled with a single L-shaped tool movement or when arranged on both sides may be milled with a U-shaped tool movement so that no additional manufacturing costs will be necessary for the application of the present invention.

Figure 1:
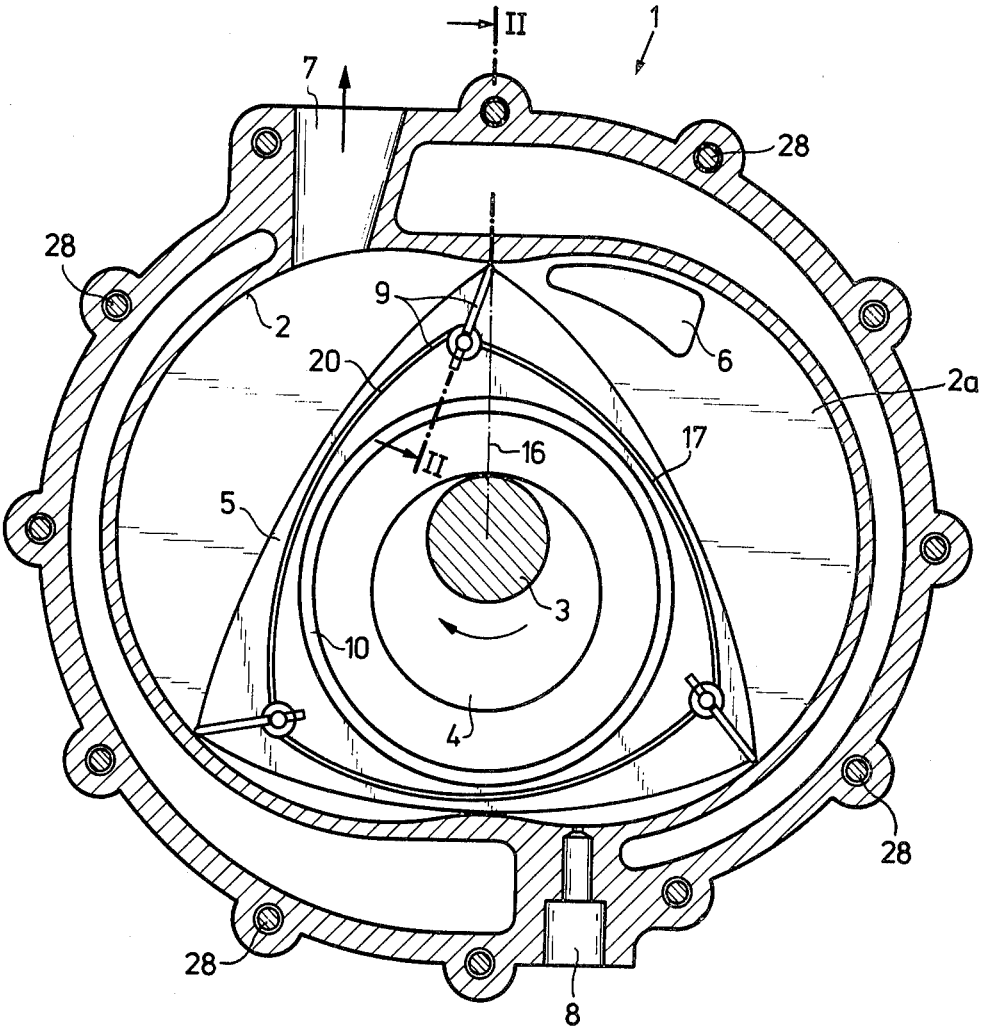
FIG. 1 is a radially sectioned view of a Wankel machine having features in accordance with the present invention.

FIG. 1 shows a radial section through a rotary piston engine of which the housing provides an inner chamber which becomes formed by a trochoidal-formed two-arc mantle path 2 and side walls 2a and 2b (FIG. 2) and in which a triangular piston 5 rotates upon an eccentric 4 around a shaft 3 passing through the side walls 2a and 2b. In the side wall 2a there is provided an inlet opening 6 and in the mantle path 2 there is provided an outlet opening 7. Further a seat 8 is provided in the housing mantle end for a spark plug or with diesel operation having a fuel injection nozzle or jet. The piston 6 provides a radial and axial gas sealing system 9 illustrated in enlarged form in detail in FIGS. 2 and 3 and also provides an inner circular-formed oil seal 10.

Figure 2:
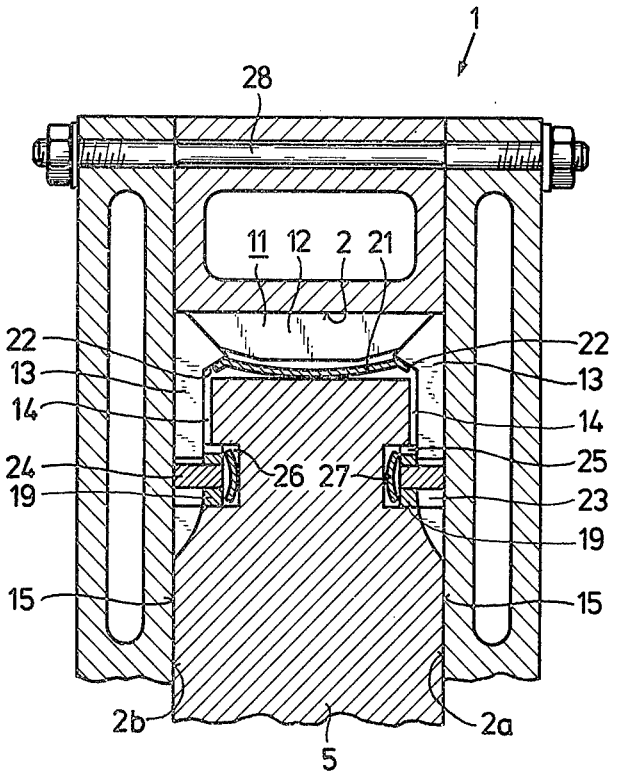
FIG. 2 is a section taken along line II—II of FIG. 1.
Figure 3:
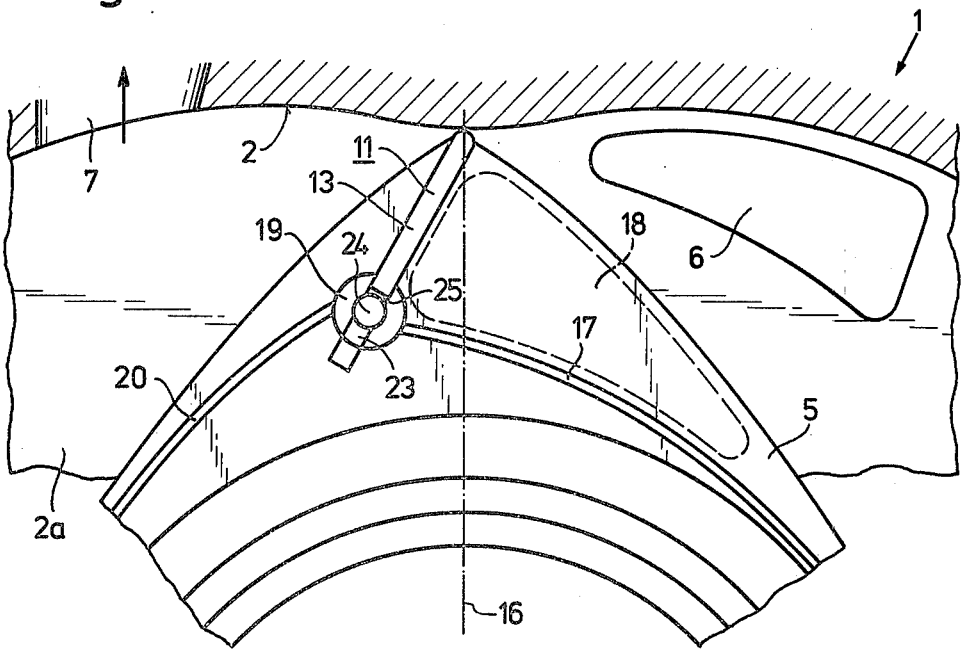
FIG. 3 is an enlarged partial view of the piston end surface with the corner seal according to the invention.

FIG. 2 represents an enlarged partially sectioned view taken in a plane II—II of FIG. 1. FIG. 3 is an illustration of an enlarged section of FIG. 1.

Referring now to the drawings in detail, the corner part 11 of the sealing strip 12 has extended legs 13 which are arranged in grooves 14 in the piston end face walls 15. These grooves are offset by an angle of approximately 30° relative to the center line 16 of the piston. The sealing strip 17 is set back inwardly and thus frees a surface 18 on the piston end face wall which can pass over the lateral inlet control opening while gases under pressure cannot pass through said inlet opening behind the sealing strip 17 or behind the sealing bolt 19. With a charged motor or a second or additional compressor stage with which the transfer of the working medium is effected through the lateral inlet opening in conformity with the cycle of the motor or said compressor stage, the front end of the sealing strip as illustrated with the next succeeding sealing strip 11 can engage a point on the sealing bolt 19, which point is closer to the pertaining piston flank. This is due to the fact that the piston flank slides over the lateral inlet opening as long as the latter is closed.

The corner part 11 and its legs 13 are pressed on by the strip spring 21 which rests against the surface 22 that is slanted by about 30 degrees with regard to the axial direction. In this way, the corner parts are pressed toward the side wall and also in the direction toward the mantle path against the sealing strip 12. The sealing bolts 19 which connect the legs 13 to the sealing strips 17 and 20 is, together with the grooves 14 of the legs 13, milled in radial direction. The grooves 23 thus formed in the sealing bolts are blocked off by the closure bolts 24 in order to prevent the pressure medium from passing into the space between the outer and inner seal. A gas guiding grooves 25 establish communication between the spring chambers 26 behind the sealing bolts 19 in which the springs 27 are provided and the groove chamber 14 of legs 13 to thereby permit the function of the sealing bolt. Reference numeral 28 designates the screw bolts connecting the housing parts together in assembled relationship.

It is, of course, to be understood that the present invention is not limited to the specific showing in the drawing, but also comprises any modifications within the scope of the appended claims.

What is claimed is:

1. A rotary piston machine for operation by introduction of air into a compression chamber, said machine comprising a housing having a multi-arc peripheral inner surface of epitrochoidal cross section and end walls in planes perpendicular to said peripheral wall, and a multi-corner piston rotatable in said housing with its corners in sealing contact with said peripheral surface to form a plurality of working chambers, said piston having radial planes extending through the axis of said piston and said corners, one of said end walls of said housing having an inlet opening adjacent the peripheral wall to admit air under pressure into a working chamber, said rotary piston having a plurality of seal strips on each end wall to engage said end walls of the housing, said seal strips extending substantially circumferentially and disposed radially inwardly of the radial inner limit of said inlet opening to seal the working chambers outwardly of said seal strips, sealing bolts radially inwardly of the radial inner limit of said inlet opening and positioned rearwardly in rotational direction of said piston relative to the radial planes through the corners of said piston, the path of said sealing bolts lying inwardly of said inlet opening, the ends of said seal strips intersecting said bolts, a corner seal on each corner of said piston, said corner seal having a strip across the corner of said piston engaging said peripheral inner surface and legs extending inwardly and rearwardly from the radial plane through the corner relative to rotation of said piston, said legs intersecting said sealing bolts, so that the seal strip and corner seal leg on the corner of the piston leaves a large free area on the end of said piston forward of said corner seal leg and provides maximum admission of air through said inlet opening in the compression chamber.

2. A rotary piston machine as claimed in claim 1, in which the area of the piston end wall forwardly of the corner seal leg and outwardly of the circumferentially extending seal strip is as large as the area of the inlet opening.

3. A rotary piston machine as claimed in claim 1, in which the outer side of said inlet opening is adjacent to the peripheral wall of said chamber and substantially parallel thereto.

4. A rotary piston machine as claimed in claim 1, in which the inner side of said inlet opening is substantially concentric to the axis of the chamber, said axis coinciding with the axis of the shaft of said machine.

5. A rotary piston machine for operation by introduction of air into a compression chamber said machine comprising a housing having a multi-arc peripheral inner surface of epitrochoidal cross section and end walls in planes perpendicular to said peripheral wall, and a multicorner piston rotatable in said housing with its corners in sealing contact with said peripheral surface to form a plurality of working chambers, said piston having radial planes extending through the axis of said piston and said corners, one of said end walls of said housing having an inlet opening adjacent the peripheral wall to admit air under pressure into a working chamber said rotary piston having a plurality of seal strips on each end wall to engage said end walls of the housing, said seal strips extending substantially circumferentially and disposed radially inwardly of the radial inner limit of said inlet opening to seal the working chambers outwardly of said seal strips, sealing bolts radially inwardly of the radial inner limit of said inlet opening and positioned rearwardly in rotational direction of said piston relative to the radial planes through the corners of said piston, the ends of said seal strips intersecting said bolts, a corner seal on each corner of said piston, said corner seal being positioned in a groove in said piston extending transversely across the corner of said piston and radially inwardly along the end walls of said piston to said sealing bolts, said corner seal comprising a transverse sealing strip in said transverse groove in said corner and inwardly extending sealing legs in the grooves in said end walls and in sealing engagement with said transverse strip and said sealing bolts, and a spring in said transverse groove and in engagement with said strips to press said transverse corner strip radially outwardly into engagement with said peripheral wall and said corner strips axially into engagement with the end walls of said chamber, the seal strip and corner seal leg on the corner of said piston and on the piston end wall opposite the chamber end wall with said inlet opening leaving a large free area on the end of said piston forward of said corner seal leg at least as large as the area of said inlet opening, thereby providing maximum admission of air through said inlet opening in the compression chamber.

6. A rotary piston machine as claimed in claim 5, in which said inlet opening has its outer side adjacent to and parallel with the peripheral wall of said chamber, and its inner side concentric to the axis of said chamber which coincides with the axis of the shaft of said machine.

7. In a rotary piston engine; a housing with a piston chamber having a peripheral wall and end walls and a multi-corner piston in the chamber also having a peripheral wall and end walls, an opening formed in one end wall of said chamber, end seal strips on the ends of said piston to engage the end walls of said chamber and disposed radially inwardly from the radially inner limit of said opening, sealing bolts at each end of the piston at the juncture of the respective said strips, and corner seal elements at the corners of said piston and including legs extending inwardly along the ends of said piston to said sealing bolts, each of the corner seal elements being mounted in a groove provided therefor in said piston, each groove when viewed in the axial direction of the piston being disposed in a plane which inclines rearwardly of the piston from the radial plane of the piston which passes through the respective corner of the piston, said piston having an axial recess for each sealing bolt, the piston furthermore comprising a passage formed therein communicating the bottom of each recess with region of the groove for the adjacent corner seal element which is radially outward from the said recess.

8. A rotary piston engine according to claim 7 in which said groove for each corner seal element individually comprises a slot formed continuously in a single tool setting.

9. In a rotary piston engine; a housing with a piston chamber having a peripheral wall and end walls and a multi-corner piston in the chamber also having a peripheral wall and end walls, an opening formed in one end wall of said chamber, end seal strips on the ends of said piston to engage the end walls of said chamber and disposed radially inwardly from the radially inner limit of said opening, sealing bolts at each end of the piston at the juncture of the respective said strips, corner seal elements at the corners of said piston and including legs extending inwardly along the ends of said piston to said sealing bolts, each sealing bolt being larger in diameter than the thickness of the respective corner seal element and having a slot to receive the respective corner seal element, and a closure bolt coaxial with said sealing bolt and sealing said slot against the passage of gas.

10. A rotary piston engine according to claim 8, in which each of the corner seal elements individually comprises an axial portion engaging the peripheral wall of said chamber and end portions at the ends of said piston engaging the opposite ends of said axial portion and engaging said end walls of said chamber, said end portions extending from the peripheral wall of said chamber inwardly to said sealing bolts, and a spring contacting said piston and engaging said end portions and urging the end portions outwardly on said piston.

11. A rotary piston engine according to claim 10 in which each corner seal element is mounted in a groove provided therefor in said piston, each groove when viewed in the axial direction of the piston being disposed in a plane which inclines rearwardly of the piston from the radial plane of the piston which passes through the respective corner of the piston.

12. A rotary piston engine according to claim 10 in which the opposite ends of said axial portion are bevelled inwardly and the outer ends of said end portions are correspondingly bevelled.

13. A rotary piston engine according to claim 10 in which said spring is a leaf spring and has opposite ends engaging said end portions, the region of each end portion engaged by a spring end comprising a surface inclined at about 30° to the axis of said piston and diverging from said axis in the direction toward the opposite end of the piston.

* * * * *